United States Patent [19]

Wehl

[11] Patent Number: 5,077,535

[45] Date of Patent: Dec. 31, 1991

[54] THERMOSTATIC SWITCH WITH SINUOUS BIMETAL BLADE

[75] Inventor: Glenn F. Wehl, North Canton, Ohio

[73] Assignee: Portage Electric Products, Inc., North Canton, Ohio

[21] Appl. No.: 567,001

[22] Filed: Aug. 13, 1990

[51] Int. Cl.[5] ..... H01H 37/52; H01H 71/16

[52] U.S. Cl. ..... 337/373; 337/111; 337/362

[58] Field of Search ..... 337/111, 373, 372, 362, 337/380

[56] References Cited

U.S. PATENT DOCUMENTS 3,223,809 12/1965 Wehl ..... 337/372
3,656,080 4/1972 Wells ..... 337/111

FOREIGN PATENT DOCUMENTS 465667 6/1950 Canada ..... 337/379
334098 7/1936 Italy ..... 337/362

*Primary Examiner*—Harold Broome
*Attorney, Agent, or Firm*—Darby & Darby

[57] ABSTRACT

A thermostatic switch has a bimetallic member formed with an undulated section for causing both an axial and a radial displacement of the bimetallic member such that each time the member expands a first contact wipes across a second contact. By providing sufficient undulations, the wiping action occurs prior to and after separation of the contacts preventing the build-up of a resistive residue which could interfere with switch operation. Utilizing the undulated bimetallic section in a thermostatic switch increases the life of the contacts and reduces variations in temperature responsiveness.

4 Claims, 1 Drawing Sheet

FIG. 1
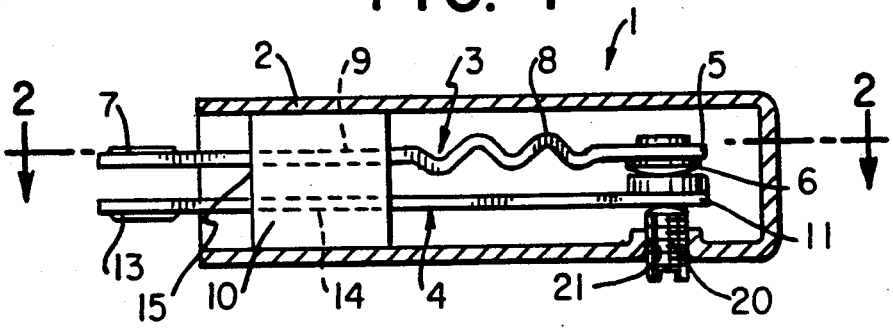
FIG. 2
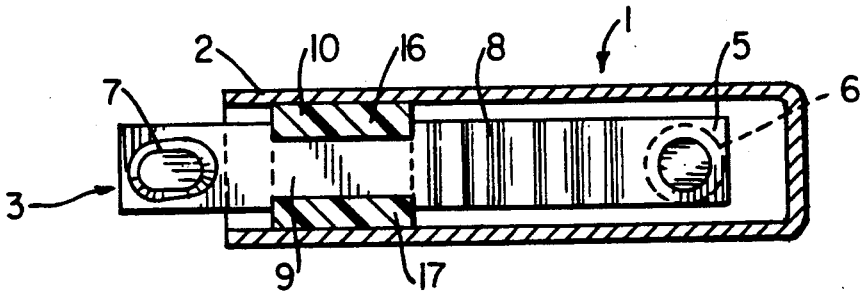
FIG. 3
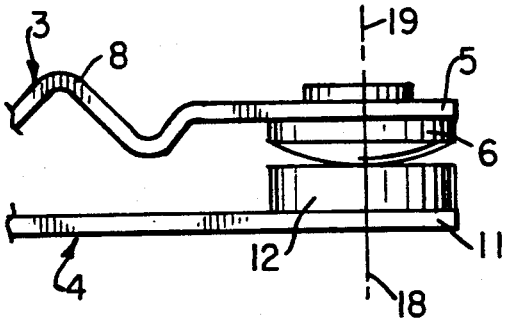
FIG. 4
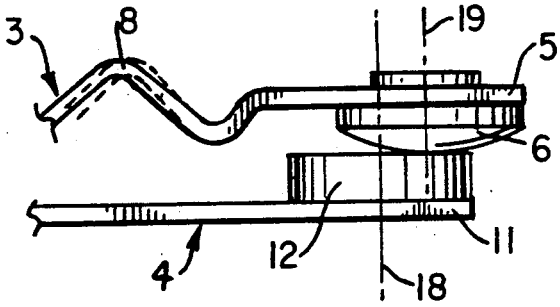
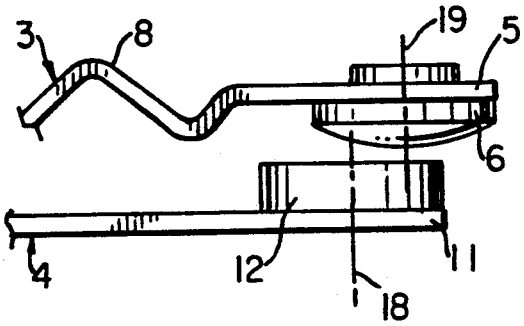
FIG. 5

THERMOSTATIC SWITCH WITH SINUOUS BIMETAL BLADE

TECHNICAL FIELD

This invention relates to thermostatic switches, and more particularly to a thermostatic switch which includes a sinuous bimetal blade.

BACKGROUND OF THE INVENTION

Many thermostatic switches are known which have contacts mounted on one or more flexible strips, with at least one of the flexible strips being formed of, or biased by, a bimetal material for movement subject to temperature variations. With such constructions, it is possible to provide relatively accurate electrical control responsive to temperature changes.

One particular type of thermostatic switch is the creep-action thermostatic switch. The creep-action is accomplished by the use of a bimetallic member, which, through expansion causes a pair of contacts to separate when a preset temperature is reached. Due to the creep-action, there is a gradual separation of the contacts, as the contact disposed at the end of the bimetallic member moves into or out of engagement with a mating contact. The contacts typically engage at the same contact point with the making and breaking of the contacts producing an arc as current begins to flow or is stopped. The continued proximity of the contacts after separation increases the propensity for arcing, producing a residue on the contact surfaces. Frequent cycles cause a residue build-up which increases the resistance between the contacts and affects switch operation.

SUMMARY OF THE INVENTION

It is an object of the present invention to provide a thermostatic switch which has a bimetallic member which responds to a temperature increase by causing a sliding movement between the contacts to prevent a build-up of residue on the contact surfaces.

It is another object to provide a thermostatic switch which has a bimetallic member formed in an undulated shape which expands both radially and axially to cause wiping of the contact surfaces prior to opening of the switch.

These and other objects of the present invention are achieved by providing a thermostatic switch including at least one bimetallic member having an undulated section, and a first contact placed at an end thereof. A second member is provided having a second contact at an end thereof which is mateable with the first contact. When the temperature reaches a predetermined value, the bimetallic member first expands axially, causing wiping of the mating contact surfaces with a continuing increase in temperature causing radial displacement of the first contact away from the second contact, to open the circuit. Utilizing a bimetallic member with an undulated section cleans the contact surfaces by causing a wiping action which prevents the build-up of a resistive residue on the contacts.

BRIEF DESCRIPTION OF THE DRAWINGS

FIG. 1 is a cross sectional view of a thermostatic switch including the undulated bimetallic member.

FIG. 2 is a top sectional view of the thermostatic switch of FIG. 1.

FIG. 3 is an enlarged view of contacts of FIG. 1.

FIG. 4 is an enlarged cross sectional view of the contacts of FIG. 1 in an intermediate expansion position.

FIG. 5 is an enlarged cross sectional view of the contacts of FIG. 1 shown in the completely expanded condition.

DETAILED DESCRIPTION OF THE INVENTION

Referring to FIG. 1, a thermostatic switch 1 has a casing 2 housing a pair of contact strips 3 and 4. The strip 3 has a contact end 5, a first contact 6 attached to the end 5 and a lead end 7 for connection to a circuit. The contact strip 3 has a bimetallic portion 8 which is formed with an undulated or corrugated shape. The bimetallic portion 8 extends from a mounting portion 9 which resides in an insulator block 10.

The contact strip 4 has a contact end 11 to which a contact 12 is attached and has a lead end 13 extending from the casing. The contact strip 4 also has a mounting portion 14 which resides within the insulator block 10. Typically, the mounting portions 9 and 14 are separated by an insulative separator 15 to prevent short circuiting between the contact strips Also, with the wiping action of the present invention, it is preferable that the contact 12 have a flat rather than rounded surface. An adjustable stop screw 20 extends through a threaded opening 21 to support the contact strip 4. The screw is made of an insulating material, or is otherwise insulated, to prevent short circuiting. Of course, a dimple could be substituted for the screw.

Referring to FIG. 2, a top sectional view of the thermostatic switch of FIG. 1 is shown. The insulator block 10 has a pair of side portions 16 and 17. The mounting portion 9 of the contact strip 3 fits within the insulator block 10 between the side portions.

Referring to FIG. 3, the contacts 6 and 12 are shown in engagement, such as when the bimetallic section 8 is essentially at a temperature below the desired opening valve. In such a condition, the contacts are mated and are in co-axial alignment along a common axis 18.

Referring to FIG. 4, an intermediate position of the contacts is shown where heating has begun to occur, but the temperature has not risen to the point where the contacts are set to break and, therefore, open the circuit. As seen in FIG. 4, as the bimetallic portion 8 expands, from the initial position shown in phantom, the undulations tend to extend axially in an attempt to straighten out the strip. As this occurs, the first contact 6 is moved across the surface of the second contact 12 and thus the contacts are no longer coaxial, as the axis 19 of contact 6 now is spaced away from the axis 18 of contact 12. Since the contacts rub against each other during each opening and closing of the contacts, any build-up of residue due to arcing which occurs when the contacts separate is minimized or wiped away, increasing the life of the contacts.

Referring to FIG. 5, it is seen that the continuing expansion of the bimetallic portion 8 eventually results in a radial as well as axial displacement, and when the predetermined temperature is reached, this displacement causes the contacts 6 and 12 to separate.

While only two sinuous undulations are shown, the number is limited only by the length of the arm. The bimetallic contact member may have from 1–12 undulations and is preferably designed to have, when in its shortened condition, some biasing in a downward direction to urge the contacts together. The undulations are preferably formed to cause both a radial (upward) and an axial displacement and thus as the displacement increases, the amount of biasing decreases to the point where, eventually, the contacts open.

Utilizing a sinuous bimetal contact strip has the additional advantage of reduced stress. The mechanical stress in a cantilever member such as the bimetal strip is measured as follows:

$$S = \frac{1.5\, M\, D_T\, t}{L^2} \text{ where}$$

$S$ = Stress (psi)
$M$ = Modulus of elasticity (psi)
$D_T$ = Deflection (inches)
$t$ = Thickness (inches)
$L$ = Active Strip Length (inches)

If the strip is overstressed, it will be deformed permanently. Since the physical length is typically restricted due to the switch casing size, adjustments to the strip thickness are typically made to accommodate the anticipated stress levels. Utilizing an undulated blade provides the option of increasing the active length of the strip without increasing the physical length. Thus, stress limits can be increased for strips of similar thickness. This increased active length also provides more bimetal material thereby increasing the sensitivity of switch operation.

Another advantage of this increased stress tolerance is the maintenance of calibration. With some thermostatic switches, after calibration, significant stress is placed on the bimetallic strip. If dropped, the stress limit may be exceeded and the calibration lost. By using the undulated portion, the stress limit may be increased sufficiently to avoid losing calibration if the switch is dropped.

The materials used for switch construction are those conventionally known in the field. The lower contact strip is formed from an electrically conductive metal such as brass, with the upper bimetallic member either formed totally of a bimetal material or formed of a composite metal strip including bimetal layers formed on one side thereof. The contacts are typically formed of a silver alloy. The casing may be made of brass, steel, aluminum or another metal. If a dead case-type thermostatic switch is to include the structure of the present invention, the casing may be made of a nonconducting material.

In the described embodiment of the present invention, the lower contact strip 4 is composed of a non-bimetallic material and, therefore, does not change position in response to changes in temperature.

It will be understood by those skilled in the art that the choice of bimetallic member, the choice of insulating block material, whether one or both contact arms are bimetallic members, etc., are all within the skill of one versed in this art. While various specific embodiments of the present invention have been shown and described, the invention should not be considered as limited to these embodiments, but also includes other embodiments within the scope of the present invention.

I claim:

1. A thermostatic switch having a housing, an insulator block disposed in the housing, a first contact strip supported by the insulator block and being a non-bimetallic member having a contact end and a lead end, a first contact mounted on the contact end of the first strip, an insulative separator disposed on the first contact strip, a second contact strip being a bimetallic member responsive to temperature variations disposed on the insulative separator, the second contact strip having a contact end and a lead end, a second contact mounted on the contact end of the second strip, one of the contacts having a flat surface and one of the contacts having a rounded surface, an undulated section arranged between the lead end of the second strip and the second contact, the undulated section having at least one undulation to cause axial and radial displacement upon changes in ambient temperature, such that the surfaces of the contacts wipe against each other when the bimetallic member expands or contracts.

2. The thermostatic switch of claim 1 wherein the second strip has from 1 undulation to 12 undulations.

3. The thermostatic switch of claim 1 wherein the second strip has 2 undulations.

4. The thermostatic switch of claim 1 wherein the second contact is biased into contact with the first contact below a predetermined temperature.

* * * * *